US009296546B2

(12) United States Patent
Wichmann et al.

(10) Patent No.: US 9,296,546 B2
(45) Date of Patent: Mar. 29, 2016

(54) HINGED LID SHEET DISPENSER

(75) Inventors: Markus Wichmann, Ebertsheim (DE); Saskia Lendzian, Weinheim (DE)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 14/410,747

(22) PCT Filed: Jul. 12, 2012

(86) PCT No.: PCT/EP2012/063681
§ 371 (c)(1),
(2), (4) Date: Dec. 23, 2014

(87) PCT Pub. No.: WO2014/008938
PCT Pub. Date: Jan. 16, 2014

(65) Prior Publication Data

US 2015/0166248 A1 Jun. 18, 2015

(51) Int. Cl.
*B65D 83/08* (2006.01)
*B65D 5/52* (2006.01)
*B65D 43/16* (2006.01)

(52) U.S. Cl.
CPC ..... *B65D 83/08* (2013.01); *B65D 5/5206* (2013.01); *B65D 5/5253* (2013.01); *B65D 43/162* (2013.01); *B65D 83/0847* (2013.01);
(Continued)

(58) Field of Classification Search
CPC .. B65D 5/5206; B65D 5/6697; B65D 43/162; B65D 83/08; B65D 2543/00009; B65D 2583/082; B65D 2313/00
USPC ..... 206/45.2–45.24, 449–456, 494, 526; 229/125.11, 125.08; 40/107
See application file for complete search history.

(56) References Cited

U.S. PATENT DOCUMENTS 457,598 A * 8/1891 Briggs ..... 206/45.23
1,358,659 A * 11/1920 Thum ..... 206/45.21
(Continued)

FOREIGN PATENT DOCUMENTS

EP 2 314 513 A1 4/2011
FR 2 587 974 A1 4/1987

OTHER PUBLICATIONS

International Search Report (PCT/ISA/210) mailed on Mar. 26, 2013, by the European Patent Office as the International Searching Authority for International Application No. PCT/EP2012/063681.
(Continued)

*Primary Examiner* — Bryon Gehman
(74) *Attorney, Agent, or Firm* — Buchanan Ingersoll & Rooney PC

(57) ABSTRACT

A dispenser includes a body having a body sidewall and an opening for dispensing sheets; a lid hingedly attached to the body and having a lid sidewall. The lid pivots relative to the body between a closed position covering at least part of the sheets and an open position, allowing access to the sheets. The body sidewall and the lid sidewall are flush in the closed position of the lid and face each other in the open position of the lid. A first connecting member and a second connecting member, one being provided on the lid and the other being provided on the body are included. The first and second connecting members cooperate in the open position to fixedly connect the lid to the body so that the dispenser is stably placeable on a horizontal surface in the open position with the body sidewall being angled to the horizontal surface.

19 Claims, 1 Drawing Sheet

(52) U.S. Cl.
CPC ..... *B65D2313/02* (2013.01); *B65D 2313/04* (2013.01); *B65D 2543/00009* (2013.01); *B65D 2583/082* (2013.01)

(56) References Cited

U.S. PATENT DOCUMENTS 2,771,986 A * 11/1956 Bekoff ..... B65D 5/6697 229/125.08
2,889,036 A * 6/1959 Davies ..... 206/45.2
4,470,538 A * 9/1984 Heathcock ..... B65D 5/6697 229/125.08
4,541,527 A * 9/1985 Nagel ..... 206/45.24
4,708,239 A 11/1987 Bourbon
6,925,739 B1 * 8/2005 Cole et al. ..... 206/45.2
7,017,744 B2 * 3/2006 Persson ..... 206/440

OTHER PUBLICATIONS

Written Opinion (PCT/ISA/237) mailed on Mar. 26, 2013, by the European Patent Office as the International Searching Authority for International Application No. PCT/EP2012/063681.

International Preliminary Report on Patentability (PCT/IPEA/409) dated Jul. 8, 2014, by the European Patent Office as the International Preliminary Examining Authority for International Application No. PCT/EP2012/063681.

Notification of the First Office Action dated Nov. 25, 2015 issued in the corresponding Chinese Patent Application No. 201280074659.0 and English translation (17 pages).

* cited by examiner

HINGED LID SHEET DISPENSER

TECHNICAL FIELD

The present disclosure relates to a dispenser for dispensing paper or non-woven sheets, such as household towels, napkins, wipes or handkerchiefs, which are preferably non-interfolded and stacked one upon the other.

BACKGROUND

Currently well-known household towels come on a roll of web material consisting of a plurality of interconnected sheets. In use the sheets are separated from the remainder of the roll along a perforation. In this instance, the roll is held by one hand, whereas the other hand separates the sheet. One-hand usage of such rolls is in most cases not possible even using common stands on which the roll may be supported. While holding the roll to tear off one sheet, the remainder of the roll may become soiled. As a result hygienic use is not possible.

SUMMARY

In view of the aforesaid, it is the object of the present disclosure to provide a dispenser which allows convenient one-hand usage and enables mobility and usage of the product independent of a separate dispenser.

This object is solved by a dispenser described herein.

The basic idea of the present disclosure is to provide a dispenser having a body and a lid wherein the lid may be fixed to the body when the lid is opened so that the dispenser is placeable upon a horizontal surface with an angled orientation. By means of the angled orientation, one-hand use is facilitated and an absolutely hygienic solution obtained. Furthermore, the dispenser may be reclosed by means of the lid so that the dispenser provides a certain mobility under hygienic conditions.

Accordingly, the present disclosure suggests a dispenser for dispensing paper or non-woven sheets. The dispenser comprises a body having a body sidewall and a dispensing opening for dispensing the sheets. For example, the body may be formed by a first pair of opposing sidewalls and a second pair of opposing sidewalls. The first pair of opposing sidewalls may extend perpendicularly to the second pair of sidewalls. Said body sidewall may be formed by one sidewall of the first and second pair of sidewalls. Further, the sidewalls of the first and second pair of sidewalls may be connected at one edge to a bottom. The dispensing opening may be defined at the opposite edge of the sidewalls opposite to the bottom. Alternatively, the body may have a curved cross-section such as a circular or oval cross section. In this case, the body sidewall is at least part of the circumferential sidewall of the body. Also in this embodiment, a bottom may be provided at one edge of the circumferential sidewall and an opening be formed at the opposite edge of the circumferential sidewall for dispensing the sheets. Further, the dispenser has a lid which is hingedly attached to the body. Thus, the lid is pivotable relative to the body between the closed position covering the opening or at least part of the sheets and an open position which allows access to the opening and, hence, to the sheets. If the body is formed from the first and second pair of opposing sidewalls, it is preferred that the lid is formed of a first and second pair of opposing sidewalls perpendicularly connected to each other as well. In this case, a top may be provided at one edge of the sidewalls and an opening at a second edge of the sidewalls opposite to the top. If the body has said curved cross section, the same preferably also applies for the lid. As a result it is preferred, that the body and the lid have a similar configuration and particularly outer shape. However, the dimensions of the body and lid may differ. According to the embodiment, the body sidewall and the lid sidewall are flush (reside in a common plane) in the closed position of the lid and face each other in the opened position of the lid. For example, the lid sidewall and the body sidewall may contact each other in the open position and/or may extend parallel to each other. In order to make the dispenser placeable on a horizontal surface in the open position of the lid with an angled orientation that is with the body sidewall being angled to the horizontal surface, a first and second connecting member is suggested. One of the first and second connecting members is provided on the lid and the other of the first and second connecting members is provided on the body. In the open position of the lid, the first and second connecting members cooperate to fixedly connect the lid to the body. For example, the first and second connecting members may be engaged for this purpose.

In order to facilitate usage of the dispenser and particularly one-hand usage, it is preferred that the angle of the body sidewall to the horizontal surface is between 30 and 70 degrees, preferably between 40 and 50 degrees and most preferred between 42 and 47 degrees when the dispenser is placed on a horizontal surface in the open position of the lid. These angles have been proven to, on the one hand, satisfy a convenient one-hand usage and, on the other hand, provide sufficient stability of the dispenser placed upon a horizontal surface.

Furthermore and according to one embodiment, a length (a) of the body sidewall and a length (b) of the lid sidewall in the closed position of the lid define a height (h) of the dispenser. As previously mentioned, the body sidewall and the lid sidewall in the closed position are flush and the length (a) of the body sidewall and the length (b) of the lid sidewall add on to define the height (h) of the dispenser ($a+b=h$). According to one embodiment, the length of the lid sidewall (b) is less than half the height (h) of the dispenser, preferably between half the height (h) of the dispenser and one fourth of the height (h) of the dispenser and even more preferred about one third of the height (h) of the dispenser. It has been proven that the larger the length (b) of the lid sidewall, the more difficult it is to pivot the lid between the closed position and the opened position particularly if the dispenser is completely filled with sheets. Further, the larger the length (b) of the lid sidewall the more the sheets protrude from the body sidewall, when the dispenser is placed upon a horizontal surface. As a result, the sheets depending on their flexibility may hang down and in the worst case fall out of the body. From this perspective, the length (b) of the lid sidewall is less than half the height of the dispenser. However, it has been proven most advantageous when the length (b) of the lid sidewall is about one third of the height of the dispenser which at the same time enables easy opening of the lid, a good support of the sheets stacked one upon the other on the body sidewall and an optimum angle of the body sidewall relative to a horizontal surface.

The first and second connecting member may be formed of a magnet and magnetic material, an adhesive label and a landing zone or the two components of a Velcro®. However, particularly in cases in which the dispenser at the same time forms part of the packaging of the sheets, it has been proven advantageous from the view point of a cost-effective and easy manufacture that the first connecting member is a tongue cut from and folded out of one of the body sidewall or the lid sidewall and the second connecting member is a slit cut into the other of the lid sidewall or the body sidewall wherein the tongue is insertable into the slit. Even though the tongue may be placed on the body or the lid sidewall and the slit on the lid sidewall or the body sidewall, it is preferred that the tongue is formed on the lid sidewall improving the stability of the connection between the lid and the body. Even though a plurality of first and second connecting members may be provided, only one first and second connecting member is preferred regarding cost and ease of manufacture.

Further, it is preferred that the width of the tongue is bigger than the width of the slit in order to provide a force fit between the tongue and the slit and thereby increase the stability of the connection.

Furthermore, the tongue may have a rectangular shape. Yet, it is preferred that the cut forming the tongue is curved, preferably along a partial circular arc so that the tongue is curved, preferably having the shape of a partial circle. This facilitates inserting of the tongue into the slit. Alternatively, it may as well be conceivable to form the tongue with a trapezoid-shape providing similar advantages.

The slit may also be formed by an arc-shaped cut and folding out a portion of the body sidewall or the lid sidewall, wherein the slit is formed near the folding line. When the tongue and the slit of this configuration interact, a click mechanism for connecting the sidewalls may be obtained.

According to one embodiment, it is preferred that the dispenser has a rectangular (box) shape in the closed position. Thus, it is preferred that the body and the lid have the aforesaid two pairs of first and second opposing sidewalls and the bottom/top connecting the sidewalls. In this embodiment, it is preferred that the dispenser is placeable on a horizontal surface in the open position of the lid resting on two corner edges. The two corner edges are preferably formed by the edge connecting one sidewall of the lid to the top of the lid and the edge connecting the body sidewall to the bottom. Positioning the dispenser on two corner edges increases the stability of the dispenser when placed on a horizontal surface resting on only two points in a side view. In addition, if the horizontal surface is wet, wetting of the dispenser may be prevented, as the contact area of the dispenser is limited to only two edges.

As previously mentioned, it is preferred that the dispenser may at the same time serve as part of the packaging of the sheets. Accordingly, it is preferred that the dispenser contains a plurality of paper or non-woven sheets. The sheets may be napkins or handkerchiefs, but are preferable household towels. The sheets may be folded in any configuration such as single-folded, C-folded or Z-folded. If the sheets are folded, this may further facilitate the one-hand use in that the upmost sheet may be gripped at the folding. However, the sheets may as well be unfolded. In order to facilitate the one-hand usage, it is preferred that the sheets are not interfolded (non-interfolded). Furthermore, the sheets are preferably stacked one upon the other.

Even though the dispenser may form a packaging of the sheets or a part thereof and may for this purpose be formed of cardboard, corrugated board or paper it is also conceivable to configure the dispenser from plastic for multiple uses and refilling with sheets. In this instance, it may well be conceivable to provide the sheets in a separate box, a part of which may be completely separated from the remainder of the box, being inserted into the body of the dispenser.

According to one embodiment and particularly when using the dispenser as part of the packaging of the sheets, it is preferred that the lid and the body are connected along a weakening before use. This weakening may be formed as a perforation to be ruptured for opening the lid. A line of perforation has the advantage that when reclosing the lid, only a small gap, if at all, remains between the lid and the body thereby preventing that the sheets within the dispenser are soiled. Yet, it may be difficult to rupture the perforation by pressing on the perforation only. Thus, it may be preferred to assist the opening by means of a thread which may be gripped at one end and pulled along the weakening. Alternatively, it may as well be conceivable to provide two lines of weakening in a distance from each other so that a strip is formed in between the body and the lid. The strip may be torn away to separate the lid from the body and making the lid pivotable relative to the body. The advantage of such a strip is that the lid may be opened more easily as it may be rotated about a distanced pivoting axis. The disadvantage, however, is that the width of the strip after removal of the strip remains as a gap when the lid is reclosed, which is less advantageous from a hygienic point of view.

Furthermore and in order to provide an attracting visual appearance of the dispenser, it may also be conceivable to use a curved line of weakening which may be curved along the entire weakening line or only part thereof. It is also conceivable to use straight portions and curved portions in combination. According to one preferred embodiment a curved line of weakening it provided opposite to the lid sidewall and the body sidewall in the closed position of the lid whereas straight portions are used in the remainder of the weakening. Thus looking upon the front of the dispenser opposite the body sidewall and the lid sidewall, the weakening provides kind of a smiling face.

Further features and embodiments may be derivable from the following description of a working example wherein the features above may be combined with one or more of the following features, unless such features contradict each other.

BRIEF DESCRIPTION OF THE DRAWINGS

The following working example is described with reference to the accompanying drawings in which.

DESCRIPTION OF A WORKING EXAMPLE

A dispenser according to a working example of the present disclosure will now be described with reference to FIGS. 1 to 3.

Figure 1:
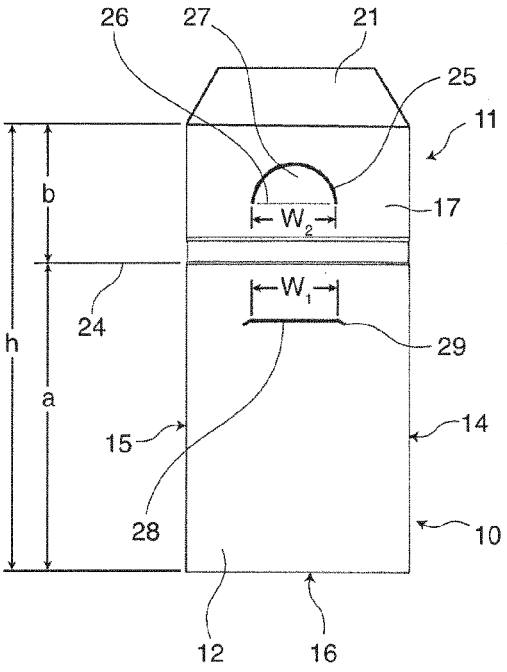
FIG. 1 shows a perspective view on the back of the dispenser defined by the body sidewall and the lid sidewall.

As shown in FIG. 1, the dispenser has a rectangular basic shape substantially defined by the outer shape of a body 10 and a lid 11. In this embodiment, the dispenser is entirely made of cardboard. However, the dispenser may well be made from corrugated board paper or plastic or even other materials.

The body 10 has a rectangular outer shape and is formed of two opposing first side walls 12, 13 (see FIGS. 2 and 3) perpendicularly connected to two other opposing sidewalls 14, 15. The sidewalls 12, 13, 14 and 15 are all perpendicularly connected to a bottom wall 16. Thereby four corner edges are formed between each sidewall 12, 13, 14, 15 and the bottom, 16, respectively.

The lid 11 also has a rectangular outer shape. The rectangular outer shape of the lid 11 is defined by two first opposing sidewalls 17, 18 (see FIGS. 2 and 3) perpendicularly connected to two second opposing sidewalls 19, 20. The four sidewalls 17, 18, 19, 20 are perpendicularly connected to a top wall 21. A corner edge is formed between each of the sidewalls 17, 18, 19, 20 and the top wall 21.

FIG. 1 shows a view on the back of the dispenser on the sidewalls 12 and 17. The walls 12 and 17 define the body sidewall 12 and the lid sidewall 17, respectively.

Figure 2:
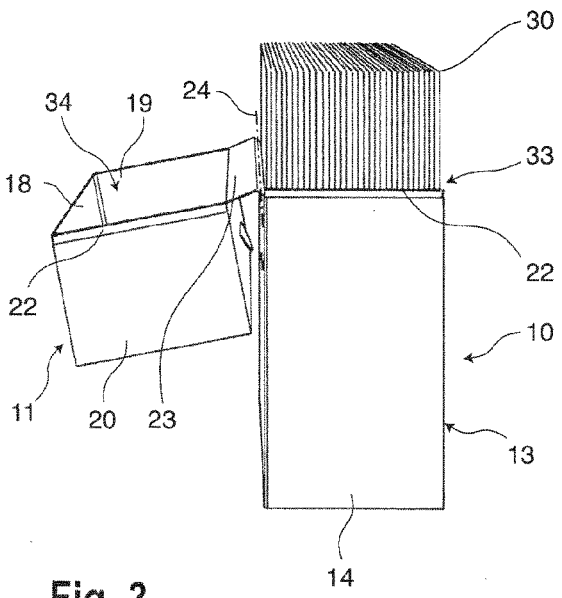
FIG. 2 shows a perspective view of the dispenser shown in FIG. 1 with the lid being pivoted toward the open position before the corporation of the connecting members.

As best visible from FIG. 2, two linear lines of weakening 22 are formed at an interface between the body 10 and the lid 11. The lines of weakening 22 are arranged in a distance to each other and extend parallel. The portion between the lines of weakening defines a strip (not shown) partly surrounding the dispenser. Particularly, the strip extends along the sidewalls 13, 14, 15 of the body 10 and the sidewalls 18, 19, 20 of the lid 11. The strip is to be torn away and separated from the remainder of the dispenser. The line of weakening 22 is for example formed by a laser score as commonly known in the packaging technology and enabling that the strip defined between the parallel lines of weakening 22 may be torn away from the remainder of the dispenser. According to this particular example, the strip is entirely separated from the dispenser as can be seen from FIG. 3. Once the strip has been removed, a web 23 in the closed position flush with the sidewall 12 of the body 10 and the sidewall 17 of the lid 11 remains that connects the lid 11 to the body 10. By removing the strip, the lid 11 becomes pivotable relative to the body 10 about the axis 24 shown in FIGS. 1 and 2. Further, by removing the strip, i.e. separating the lid 11 from the body 12, a dispensing opening 33 is formed at the edge of the sidewalls 12, 13, 14, 15 opposite to the bottom wall 16. An opening 34 is as well formed at the edge of the sidewalls 17, 18, 19, 20 opposite to the top wall 21 of the lid 11.

It is emphasized at this point that also other weakening such as perforations and/or the implementation of a thread which may be used for opening the dispenser by pulling may be implemented instead of the particular example described above.

As best visible from FIG. 1, the lid sidewall 17 and the body sidewall 12 have a width and a length, wherein the sidewalls are separated by the axis 24. The length a of the body sidewall 12 and the length b of the lid sidewall 17 add up to define the height h of the dispenser. In the particular embodiment, it is preferred that the length a of the body sidewall 12 is two third of the height h of the dispenser, whereas the length b of the lid sidewall 17 is one third of the height h of the dispenser. Yet, other ratios between the length a and the length b are conceivable as long as the length b is less than half the height h of the dispenser.

Further, and as shown in FIG. 1, a cut 25 having a partial circular arc shape is formed in the lid sidewall 17. The cut 25 forms a tongue 27 (first connecting member) that may be folded out of the lid sidewall 17 about a folding line 26 as shown in FIGS. 2 and 3.

Furthermore, a slit 28 (second connecting member) is formed in the body sidewall 12. The slit 28 is formed by a cut having a linear extension. The ends 29 of the cut may be angled. The slit 28 may even be formed by a curved cut and a portion of the sidewall 12 may be folded outwardly to create the slit as described above.

The width $W_1$ of the linear portion (without the angled ends 29) of the slit 28 is smaller than the width $W_2$ of the tongue 27. The tongue 27 may thus be held within the slit 28 by force-fit.

Even though the connecting members in this embodiment are formed as tongue and slit, other connecting members such as a magnet and magnetic material, Velcro® members, press buttons or an adhesive tape and a corresponding landing zone are conceivable.

Figure 3:
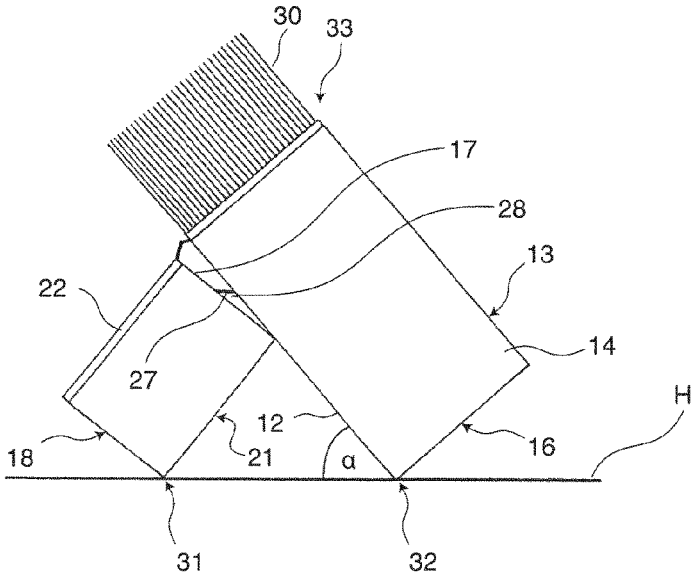
FIG. 3 shows a side view of the dispenser of FIGS. 1 and 2 with the lid in the open position and with cooperating connection members and being placed upon a horizontal surface.

Moreover and as shown in FIGS. 2 and 3, a plurality of sheets 30 made of tissue or non-woven are contained in the dispenser. The sheets may be folded or unfolded, but are preferably non-interfolded. Further, the sheets 30 are stacked one upon the other.

The dispenser shown in FIG. 1 may also serve as a package of the sheets 30 or a part of such package. For this purpose the dispenser may additionally be contained in a transparent wrapper for shelving.

In the following, the use of the dispenser will be described in more detail.

Before use, the strip (not shown) needs to be separated from the body 10 and the lid 11 along the weakening 22. Thereby, the lid 11 becomes openable and may be pivoted about the axis 24 between a closed position as shown in FIG. 1 and an open position as shown in FIG. 3. As visible from FIG. 1, the body sidewall 12 and the lid sidewall 17 are flush in the closed position. That is, the body sidewall 12 and the lid sidewall 17 extend parallel in the same plane and connect to each other at the position of the axis 24. In the closed position, the lid 11 is put over a portion of the stack of sheets protruding from the dispensing opening 33, whereby the sheets enter the interior of the lid 11 through its opening 34. Thereby the sheets are protected from becoming soiled when not in use or transported from one location to another.

In the open position, the lid sidewall 17 and the body sidewall 12 face each other. In some cases, the lid sidewall 17 and the body sidewall 12 may contact each other and/or extend parallel to each other. Once the lid has been brought to an intermediate position between the fully open and the closed position as shown in FIG. 2, the tongue 27, after being folded out of the lid sidewall 17 about the folding line 26, may be gripped and inserted into the slit 28 in which the tongue 27 is held by means of a force-fit.

Once the tongue 27 and the slit 28 are engaged as shown in FIG. 3, the dispenser may be placed upon a horizontal surface H resting on the corner edge 31 between the sidewall 18 (opposite to the lid sidewall) and the top wall 21 of the lid 11 and the corner edge 32 between the body sidewall 12 and the bottom wall 16. Thereby, it is enabled that the body sidewall 12 is angled at an angle $\alpha$ relative to the horizontal surface H. The angle $\alpha$ recites within the range of 30 and 70 degrees and in the particular embodiment is about 45 degrees. The 45 degrees angle is in the present embodiment obtained because of length a being ⅔ of the height h and the length b being ⅓ of the height h. In this position, a user may grasp the upmost sheet 30 in the stack of sheets 30, if folded at the fold, and extract the sheet from the dispenser using one hand only.

After use, and by pivoting the lid 11 about the axis 24 back in the closed position, the tongue 27 disengages from the slit 28 to thereby enable reclosing of the dispenser and maintaining the remaining sheets clean.

Even though, the dispenser has been described with respect to one working example, this example is not to be considered restrictive. Rather, several modifications may be made as described previously and without departing from the embodiments as defined herein.

The invention claimed is:

1. A dispenser for dispensing paper or non-woven sheets, the dispenser comprising:

a body having a body sidewall and an opening for dispensing the paper or non-woven sheets;

a lid hingedly attached to the body and having a lid sidewall, the lid being pivotable relative to the body between a closed position at least partly covering the paper or non-woven sheets, and an open position which allows access to the paper or non-woven sheets, wherein the body sidewall and the lid sidewall are in a same plane as each other in the closed position of the lid and face each other in the open position of the lid; and a first connecting member and a second connecting member, one of the first connecting member and the second connecting member being provided on the lid and the other being provided on the body, wherein the first and second connecting members cooperate in the open position of the lid to fixedly connect the lid to the body so that the dispenser is placeable on a horizontal surface in the open position of the lid with the body sidewall being angled to the horizontal surface, and the first connecting member is a tongue cut from and folded out of one of the body sidewall or the lid sidewall, and the second connecting member is a slit cut into the other of the lid sidewall or the body sidewall, and the tongue is insertable into the slit.

2. The dispenser according to claim 1, wherein when the dispenser is placed on the horizontal surface in the open position of the lid, an angle of the body sidewall to the horizontal surface is between 30° and 70°.

3. The dispenser according claim 1, wherein a length of the body sidewall and a length of the lid sidewall in the closed position of the lid define a height of the dispenser and the length of the lid sidewall is less than half the height of the dispenser.

4. The dispenser according to claim 1, wherein the width of the tongue is larger than the width of the slit.

5. The dispenser according to claim 4, wherein the cut forming the tongue is curved.

6. The dispenser according to claim 4, wherein the slit is formed by an arc-shaped cut and folding a portion of one of the lid sidewall and the body sidewall outwardly, the slit being formed near a line of the folding.

7. The dispenser according to claim 1, wherein the dispenser has a rectangular cross-sectional shape in the closed position and is placeable on the horizontal surface in the open position of the lid while resting on two corner edges of the lid.

8. The dispenser according to claim 1, wherein a plurality of paper or non-woven sheets are contained in the dispenser.

9. The dispenser according to claim 1, wherein the dispenser is made of one of cardboard, corrugated board, paper and plastic.

10. The dispenser according to claim 1, wherein the lid and the body are connected along a weakening.

11. The dispenser according to claim 10, wherein the weakening is at least partially curved.

12. The dispenser according to claim 1, wherein when the dispenser is placed on the horizontal surface in the open position of the lid, an angle of the body sidewall to the horizontal surface is between 40° and 50°.

13. The dispenser according to claim 1, wherein when the dispenser is placed on the horizontal surface in the open position of the lid, an angle of the body sidewall to the horizontal surface is between 42° and 47°.

14. The dispenser according claim 1, wherein a length of the body sidewall and a length of the lid sidewall in the closed position of the lid define a height of the dispenser and the length of the lid sidewall is between half the height of the dispenser and ¼ of the height of the dispenser.

15. The dispenser according claim 1, wherein a length of the body sidewall and a length of the lid sidewall in the closed position of the lid define a height of the dispenser and the length of the lid sidewall is ⅓ of the height of the dispenser.

16. The dispenser according to claim 1, wherein the tongue is folded about a fold line that is provided at a distance from an edge of the body sidewall or the lid sidewall.

17. The dispenser according to claim 1, wherein an edge of the lid which forms a topmost part of the dispenser in the closed position contacts the body sidewall when the dispenser is on the horizontal surface in the open position.

18. The dispenser according to claim 1, wherein the tongue is provided in a space between the body sidewall and the lid sidewall when the dispenser is on the horizontal surface in the open position.

19. The dispenser according to claim 1, wherein the cut of the tongue is provided on a surface of the lid sidewall at a distance from an edge of the lid sidewall or is provided on a surface of the body sidewall at a distance from an edge of the body sidewall.

* * * * *